US010569113B2

(12) United States Patent
Morgan et al.

(10) Patent No.: US 10,569,113 B2
(45) Date of Patent: Feb. 25, 2020

(54) NOZZLE PROTECTION BLOW OFF CAP

(71) Applicants: Sean Morgan, Cheltenham (AU); Stuart Morgan, Cheltenham (AU)

(72) Inventors: Sean Morgan, Cheltenham (AU); Stuart Morgan, Cheltenham (AU)

( * ) Notice: Subject to any disclaimer, the term of this patent is extended or adjusted under 35 U.S.C. 154(b) by 0 days.

(21) Appl. No.: 14/737,959

(22) Filed: Jun. 12, 2015

(65) Prior Publication Data

US 2015/0273256 A1 Oct. 1, 2015

Related U.S. Application Data

(63) Continuation of application No. 12/993,965, filed as application No. PCT/AU2009/000635 on May 22, 2009, now abandoned.

(30) Foreign Application Priority Data

May 22, 2008 (AU) ..... 2008902526
Nov. 26, 2008 (AU) ..... 2008906132

(51) Int. Cl.
*A62C 31/28* (2006.01)

(52) U.S. Cl.
CPC ..... *A62C 31/28* (2013.01)

(58) Field of Classification Search
CPC ..... A62C 31/28; B05B 15/02; B05B 15/001; B05B 1/3006
USPC ..... 239/288, 288.3, 288.5, 309; 169/74, 72, 169/77, 46
See application file for complete search history.

(56) References Cited

U.S. PATENT DOCUMENTS

| | | | | |
|---|---|---|---|---|
| 2,008,593 A | | 7/1935 | Pedersen | |
| 2,430,470 A | | 11/1947 | Keefe, Jr. et al. | |
| 4,811,857 A | | 3/1989 | Thompson | |
| 5,078,290 A | | 1/1992 | Ochs | |
| 5,667,089 A | | 9/1997 | Moore | |
| 6,158,522 A | * | 12/2000 | Laderoute | A62C 31/02 169/46 |

FOREIGN PATENT DOCUMENTS

| | | |
|---|---|---|
| GB | 2021408 A | 12/1979 |
| WO | WO 2005/113153 A1 | 12/2005 |

* cited by examiner

*Primary Examiner* — Arthur O. Hall
*Assistant Examiner* — Steven M Cernoch
(74) *Attorney, Agent, or Firm* — Edwin D. Schindler

(57) ABSTRACT

A blow off cap and nozzle apparatus includes a nozzle having a tip with an aperture covered with a sealing membrane held in position over the nozzle aperture by a retaining device, so that a seal is provided for preventing ingress of contaminants into the nozzle when not in use, and the sealing membrane becomes dislodged from the nozzle when use of the nozzle commences.

8 Claims, 2 Drawing Sheets

NOZZLE PROTECTION BLOW OFF CAP

CROSS-REFERENCE TO PRIOR APPLICATION

Figure 1:
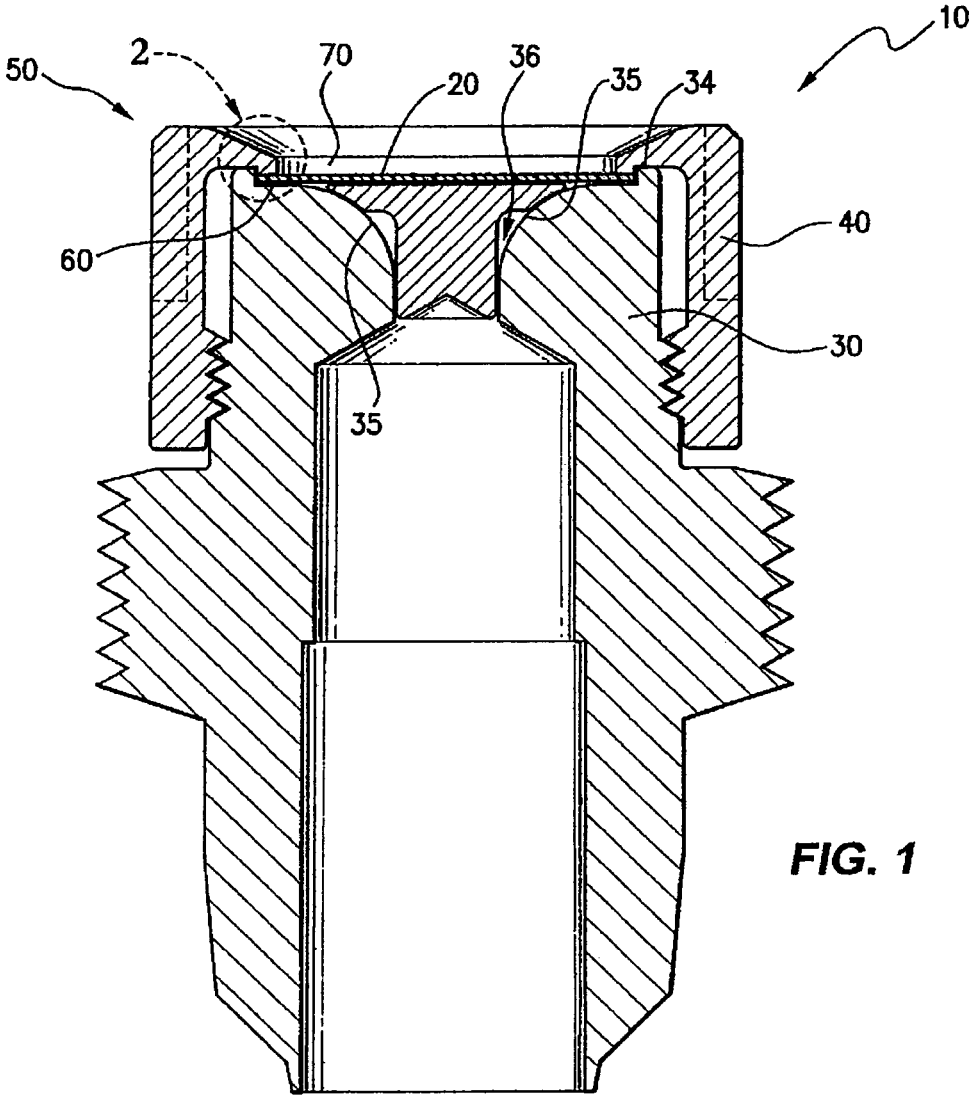

This is a continuation of application Ser. No. 12/993,965, filed Nov. 22, 2010, which represents the U.S. National Phase patent application of P.C.T. Application No. PCT/AU2009/000635, filed May 22, 2009, now abandoned.

This invention relates to the area of protective caps for maintaining the apertures in nozzles clear of foreign matter and in particular to a blow off type of protector cap, which can be used in most environments.

BACKGROUND TO THE INVENTION

Many nozzle type devices are not necessarily used very frequently and consequently are susceptible to the build up of foreign matter inside the nozzles. Typically this may occur when, for example, nozzles used in fire fighting systems are located in areas where such contamination can arise.

In addition in commercial kitchens and the like nozzles are located above hot plates and these can become clogged with grease and block their use.

It is in fact known for insects such as wasps to build nests in nozzle orifices and also for dust and other matter to build up in these orifices. One solution has been to cap the unused nozzles. One such cap of a synthetic material, which fitted over the mouth of an existing nozzle, was found to deteriorate with time and to permit foreign matter to enter the nozzle.

Further attempts to solve the blocking problems a nozzle capping means was provided in the form of a nozzle tip having a metallic sealing membrane attached thereto by retaining means that sealed the membrane to the nozzle tip. This membrane was able to be perforated when flow through the nozzle commenced however the residual membrane attached to the nozzle after perforation acted to hinder the projected spray pattern once the nozzle began spraying.

In addition in order to permit perforation of a membrane at lower pressures the membranes need to be thinner and therefore less robust and more susceptible to environmental damage.

OUTLINE OF THE INVENTION

It is an object of this invention to provide a system whereby an effective blow off cap for a nozzle is provided which is substantially free from the problems previously described above.

The invention provides a blow off cap and nozzle system including a nozzle having a tip with an aperture covered with a sealing membrane held in position over the nozzle aperture by retaining means such that a seal means is provided for preventing ingress of contaminants into the nozzle when not in use said sealing membrane becoming dislodged from the nozzle when use of the nozzle commences.

It is preferred that the retaining means be a cap which is attached to the nozzle by screw means. It is further preferred that the screw means is a screwed thread or similar retention method once the membrane is placed over the nozzle tip.

It is further preferred that the retaining cap provide a gap between its lower surface and the nozzle periphery which provides a seat for a foil disc which constitutes the sealing membrane.

It is also preferred that the membrane be manufactured to a sufficient thickness and strength such that pressure build up inside the nozzle is enough to ensure that the disc dislodges by first deforming in a convex fashion.

It is further preferred that the retaining cap have a bore, the diameter of which varies in different embodiments of the invention such that dislodgement of the convex deformed membrane occurs at varying degrees of deformation thus permitting dislodgment to occur at a variety of pressures.

It may further be preferred that the membrane be manufactured from a metallic foil such as aluminum, copper, brass, stainless steel or the like. It may however be that any preferred material may be used.

It may also be preferred that a support mechanism be provided behind the foil disc in the form of a support device which device could include a mushroom or pintle type device which assists in dislodging the disc.

In a second aspect of the invention a means for slowing the exit of the pressurised liquid about the periphery of the nozzle is provided by the stepping of the retaining lip associated with the cap and its engagement with a stepped face of the nozzle creating a gap which still permits pressure to build under the foil disc which is sufficient to facilitate its dislodgement while allowing some degree of leakage.

In order that the invention may be more readily understood we shall describe by way of non limiting example a particular embodiment of the invention with reference to the accompanying diagrams.

BRIEF DESCRIPTION OF THE DRAWING FIGURES

Figure 2:
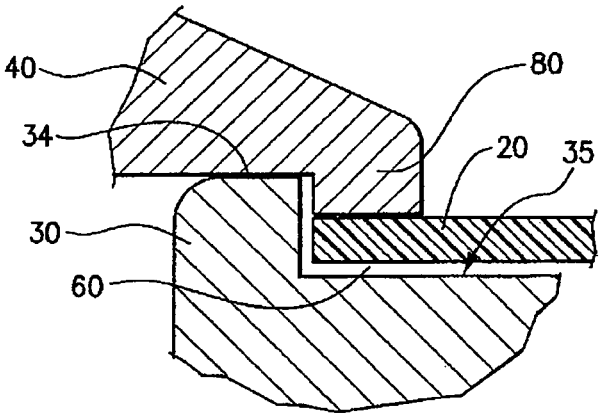
Figure 3:
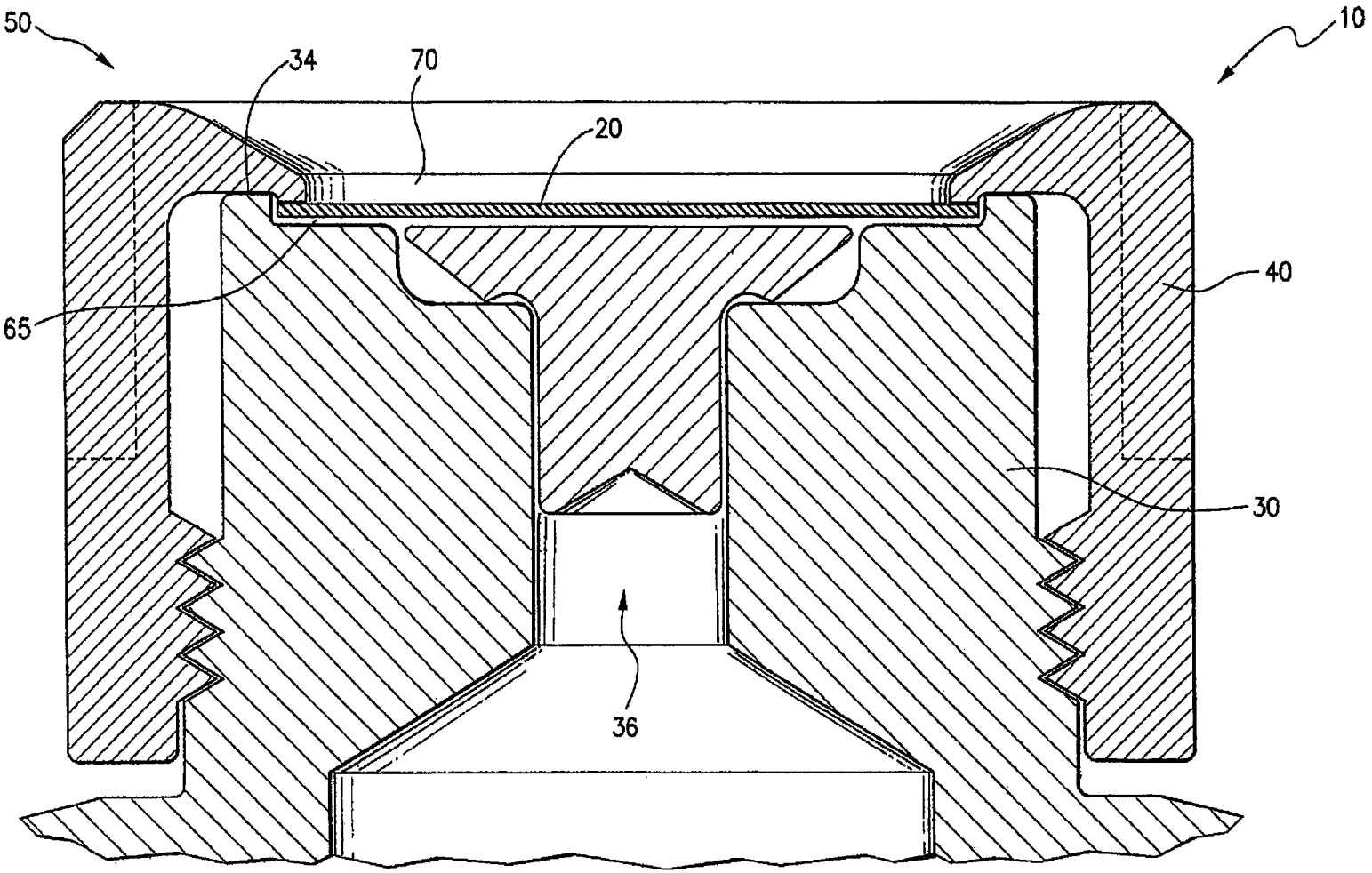

FIG. 1 Schematic diagram of a cross-section through a first embodiment of the nozzle/cap assembly;

FIG. 2 Shows detail of the disc seat mechanism of FIG. 1;

FIG. 3 Schematic diagram of a cross-section through a second embodiment of the Nozzle/cap assembly;

BRIEF DESCRIPTION OF EMBODIMENTS OF THE INVENTION

The invention 10 as shown in FIG. 1 provides a blow off cap 50 for a spray nozzle 30 where the blow off cap consists of a sealing membrane 20 in the form of a disc which covers the tip 35 of the nozzle and nozzle aperture 36 and is held in position over the nozzle tip by means of a specially designed retaining cap 40.

The arrangement is such that a gap 60 is formed between the upper face of the nozzle tip 35 and the under face of the stepped lip 80 of the periphery of the retaining cap in which the disc can be retained.

The arrangement is such that pressure below the disc causes it to deform in a convex fashion, and for its diameter to become effectively smaller, such that the disc can blow out away from the nozzle in a manner that does not hinder the flow of fluid from the nozzle.

The disc membrane is retained within its housing by a defined gap rather than being positively located by screwing down of the retaining cap. The arrangement is such that pressure behind the disc and within the nozzle causes the disc to deform in a convex fashion, with a consequent reduction in its effective diameter, allowing it to dislodge through the bore 70 of the cap.

It is an important feature of the invention that different such bore diameters be provided so that a deformed membrane can blow off at a variety of degrees of deformation and pressure.

The invention can thus include variants defined by their differing release pressures using caps differentiated by varying bore diameters while using a common membrane and nozzle body tip.

The membrane itself is manufactured to a particular thickness and strength which is enough to allow pressure build up inside the nozzle, when use is commenced, and which is sufficiently strong such that the disc does not disintegrate.

The use of the disc of the invention means that a good seal can be provided when the nozzle is not in use but that the seal can be removed at lower pressures than known in the prior art while providing undisturbed fluid flow.

The membrane used may be of a metallic foil such as stainless steel or brass or other preferred material.

The invention provides a stepped lip 80 about the inner periphery of the retaining cap 40 which is directed towards the nozzle 35 thereby defining a gap into which the disc can seat such that it is retained rather than being positively held by the retaining cap.

In a second embodiment of the invention as shown in FIG. 3 where it is preferred that a heavier duty foil disc be used it is preferred that an increased gap 65 be provided between stepped lip 80 and nozzle periphery 34 to facilitate foil dislodgement due to reduced grip.

The resulting increase in gap would normally allow some degree of leakage when flow to the nozzle commences which would normally reduce pressure build up.

However this effect is reduced by the unique nature of the resulting interlocking steps between the nozzle and retaining cap which allow the disc to dislodge more readily from its housing.

Slowing of the liquid escape is achieved by the resulting interlocking steps forming a zigzag type maze to slow the water escape while allowing pressure to build whilst leakage is occurring.

By this means the invention permits the use of thicker foil materials which are less susceptible to environmental damage than thinner foils.

The invention may also include a support mechanism behind the foil disc in the form of a support device which device could include a mushroom or pintle type device which assists in dislodging the disc.

The invention differs from the prior art in that a cover is provided over a spray nozzle which cover is readily entirely removed when use of the nozzle commences, the invention is however not restricted as to the type of materials used or the appearance and shape of its component parts and while we have described herein one particular embodiment of the invention it is to be understood that variations and modifications in the materials used and the features described can still lie within the scope of the invention.

The claims defining the invention are as follows:

1. A blow off cap and nozzle apparatus, comprising:

a spray nozzle having a nozzle tip with an aperture formed therein and an upper face and a nozzle periphery extending upwardly, the nozzle tip about the nozzle periphery defining a stepped face to said spray nozzle;

a retaining cap removably attached to said spray nozzle via a threaded connection, wherein said retaining cap abuts said nozzle periphery when the retaining cap is fully threaded onto said spray nozzle, said retaining cap having a stepped lip with an under face, said stepped lip extending downwardly from an inner periphery of said retaining cap and directed towards the nozzle tip inside of the nozzle periphery; and, a flat disc sealing membrane being seated within the nozzle periphery and having a peripheral portion with a selected thickness, the nozzle periphery and said stepped lip of said retaining cap forming interlocking steps, said stepped lip overlapping the peripheral portion, wherein, a gap with a selected height is provided between the upper face of said nozzle tip and the under face of said stepped lip, the selected height of the gap being greater than the selected thickness of the peripheral portion for facilitating loose retention of said flat disc sealing membrane when said retaining cap is fully threaded onto said spray nozzle and said spray nozzle is in an idle mode for enabling an elastic deformation and dislodgement of said flat disc sealing membrane upon activation of said spray nozzle.

2. The blow off cap and nozzle apparatus according to claim 1, wherein said retaining cap is attachable to said spray nozzle by way of a screw via said threaded connection.

3. The blow off cap and nozzle apparatus according to claim 2, wherein said retaining cap is attachable to said spray nozzle via said screw when said flat disc sealing membrane is placed over said nozzle tip of said spray nozzle.

4. The blow off cap and nozzle apparatus according to claim 1, further comprising a support for supporting said flat disc sealing membrane from behind said flat disc sealing membrane.

5. The blow off cap and nozzle apparatus according to claim 4, wherein said support is a pintle device for aiding to dislodge said flat disc sealing membrane upon activation of said spray nozzle.

6. The blow off cap and nozzle apparatus according to claim 4, wherein said support is a mushroom-shaped device for aiding to dislodge said flat disc sealing membrane upon activation of said spray nozzle.

7. The blow off cap and nozzle apparatus according to claim 1, wherein said flat disc sealing membrane is made from a metallic foil.

8. The blow off cap and nozzle apparatus according to claim 1, wherein the aperture of said nozzle tip has a diameter able to vary depending upon the selected thickness of the peripheral portion for enabling dislodgement of said flat disc sealing membrane upon activation of said spray nozzle.

* * * * *